US007401408B1

(12) United States Patent
Buch

(10) Patent No.: US 7,401,408 B1
(45) Date of Patent: Jul. 22, 2008

(54) WIRE CUTTING/TYING TOOL

(76) Inventor: Kevin Buch, 1014 Marshall Ave., Lancaster, PA (US) 17601

( * ) Notice: Subject to any disclaimer, the term of this patent is extended or adjusted under 35 U.S.C. 154(b) by 149 days.

(21) Appl. No.: 11/437,330

(22) Filed: May 19, 2006

Related U.S. Application Data

(60) Provisional application No. 60/682,312, filed on May 19, 2005.

(51) Int. Cl.
*B26B 3/00* (2006.01)

(52) U.S. Cl. ..... 30/294; 30/314; 30/317; 30/329

(58) Field of Classification Search ..... 30/294, 30/314, 315, 340, 342, 353, 356, 357, 317, 30/329
See application file for complete search history.

(56) References Cited

U.S. PATENT DOCUMENTS

| | | | | | |
|---|---|---|---|---|---|
| 392,041 | A * | 10/1888 | Lesson | 30/309 |
| 642,689 | A * | 2/1900 | Garllus | 30/294 |
| 791,009 | A * | 5/1905 | Cooper | 7/170 |
| 1,387,246 | A * | 8/1921 | Earle | 30/309 |
| 1,617,004 | A * | 2/1927 | Allen | 30/309 |
| 2,569,286 | A * | 9/1951 | Bunker | 30/329 |
| 2,598,443 | A * | 5/1952 | Roth | 30/286 |
| 2,659,143 | A * | 11/1953 | Baker | 30/317 |
| 2,759,263 | A * | 8/1956 | Shigley et al. | 30/317 |
| 3,217,635 | A * | 11/1965 | Scavullo | 99/419 |
| 4,387,510 | A * | 6/1983 | Hashemifard | 30/314 |
| 5,836,137 | A | 11/1998 | Contreras | |
| 5,842,506 | A | 12/1998 | Peters | |
| 5,947,166 | A | 9/1999 | Doyle et al. | |
| 7,195,041 | B2 * | 3/2007 | Lile | 140/117 |

* cited by examiner

*Primary Examiner*—Hwei-Siu C. Payer

(57) ABSTRACT

A tool includes a wooden handle that has a curvilinear outer surface extending along an entire length thereof. The handle has a centrally registered axial bore formed therein that travels between distal and proximal ends of the handle such that the bore passes through the entire length thereof. An elongated swivel arm has an overall length greater than the handle length and is rotatably coupled to the handle such that same freely rotates along clockwise and counter clockwise directions. A cutting blade is monolithically formed with the swivel arm, is distally spaced from the handle, and is axially offset from a centrally registered longitudinal axis of the handle. The cutting blade rotates in sync with the swivel arm and has a concave face. The cutting blade is proximally spaced from a distal end of the swivel arm.

9 Claims, 3 Drawing Sheets

WIRE CUTTING/TYING TOOL

CROSS REFERENCE TO RELATED APPLICATIONS

This application claims the benefit of U.S. Provisional Application No. 60/682,312, filed May 19, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tools and, more particularly, to a hand-operated wire cutting/tying tool for improving efficiency during construction operations.

2. Prior Art

Concrete is a commonly used building material. Forms are fashioned and concrete is poured into the forms to harden, and then the forms are removed. To reinforce the concrete, a grid of metal "rebar" rods may be placed within the forms so that when the concrete hardens, it is strengthened by the rebar. The grid can be formed by a set of horizontal rebar rods which intersects with a set of vertical rebar rods. To hold the rebar grid in place, it is common to tie off the cross joints of the intersecting horizontal and vertical bars with a wire. This is a time-consuming process when done with two separate tools for tying and cutting the wire, as is the conventional practice.

A conventional hand tie, known in the prior art, using pliers or similar tool, involves looping a strand of wire over a cross joint and pulling it tight so that the loop tightly encloses the joint with the ends of the wire twisted off to prevent unraveling. Generally, two complete twists of 360 degrees each will hold the tie in place. Sometimes the wire is doubled to prevent the wire from breaking at the tie/twist point. Because the tied joint has to hold while concrete is subsequently poured over it into the form, and may also (when the rebar is preassembled off-site) have to hold securely while the rebar grid is lifted, moved, stepped on, and handled, the wire tie must be tight and strong. Thus, sometimes it is necessary to cut and re-tie certain wires to ensure a strong structure.

Accordingly, a need remains for a wire cutting/tying tool in order to overcome the above-noted shortcomings. The present invention satisfies such a need by providing a combined wire cutting and tying tool that is convenient and easy to use, is durable yet lightweight in design, is effective in its use, and saves the user a considerable amount of time and energy. Such an apparatus advantageously eliminates the need for a mason or construction worker, to carry two separate wire cutting and tying tools. The apparatus thus increases the efficiency of the laborer, allowing them to complete more work in a shorter period of time.

BRIEF SUMMARY OF THE INVENTION

In view of the foregoing background, it is therefore an object of the present invention to provide a wire cutting/tying tool. These and other objects, features, and advantages of the invention are provided by a hand-operated wire cutting and tying tool for improving efficiency during construction operations.

The tool includes a wooden handle that has a curvilinear outer surface extending along an entire longitudinal length of the handle. Such a handle has a centrally registered axial bore formed therein. The bore travels between distal and proximal ends of the handle such that the bore effectively passes through the entire longitudinal length of the handle.

An elongated swivel arm has an overall length greater than the longitudinal length of the handle. Such a swivel arm is rotatably coupled directly to the handle such that the swivel arm conveniently freely rotates along clockwise and counter clockwise directions. The swivel arm preferably includes a first linear portion that is centrally registered within the bore and entirely passes through the longitudinal length of the handle. Such a first linear portion has a longitudinal length greater than a longitudinal length of the bore.

The swivel arm may further include a second linear portion that is monolithically formed with a distal end of the first linear portion. Such a second linear portion extends laterally and obliquely outward from the longitudinal axis of the handle and forms a first shoulder with the first linear portion. The first shoulder has a curvilinear edge for receiving a user's metacarpal thereagainst so that the user can conveniently and efficiently maintain the swivel arm at a stationary position. Such a second linear portion has a longitudinal length shorter than the longitudinal length of the first linear portion.

The swivel arm preferably also includes a third linear portion monolithically formed with the second linear portion. Such a third linear portion has a longitudinal length substantially equal to the longitudinal length of the second linear portion. The third linear portion is vertically aligned and extends parallel to the first linear portion. Such a third linear portion forms a shoulder with a distal end of the second linear portion for effectively providing a curvilinear edge at which another user metacarpal is simultaneously positioned to advantageously stabilize the swivel arm. The swivel arm may further include an arcuate portion monolithically formed with the third linear portion. Such an arcuate portion is laterally and distally displaced from the handle and has a circumference outwardly offset from an outer periphery of the handle. The arcuate portion has a hook shape and further has a tapered distal end converging away from the third linear portion.

A cutting blade is monolithically formed with the swivel arm. Such a cutting blade is distally spaced from the handle and further is axially offset from a centrally registered longitudinal axis of the handle. The cutting blade rotates in sync with the swivel arm. Such a cutting blade also has a concave face. The cutting blade is proximally spaced from a distal end of the swivel arm. Such a cutting blade preferably has a substantially triangular shape and is provided with a bottom cutting edge monolithically formed with the third linear portion. The bottom cutting edge laterally extends away from the third linear portion and oppositely faces away from the arcuate portion such that the arcuate portion and the cutting blade are offset 180 degrees.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
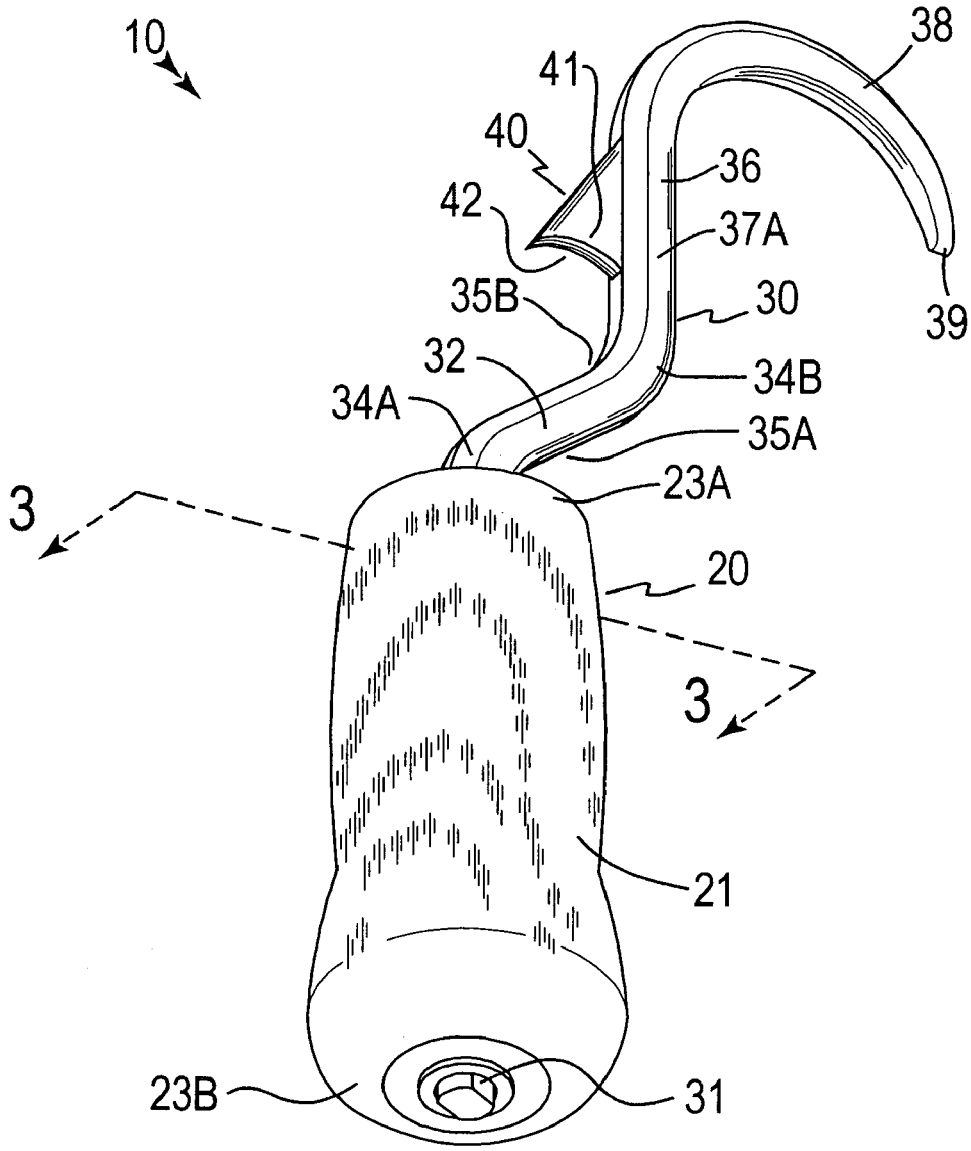
FIG. 1 is a perspective view showing a wire cutting/tying tool, in accordance with the present invention.
Figure 2:
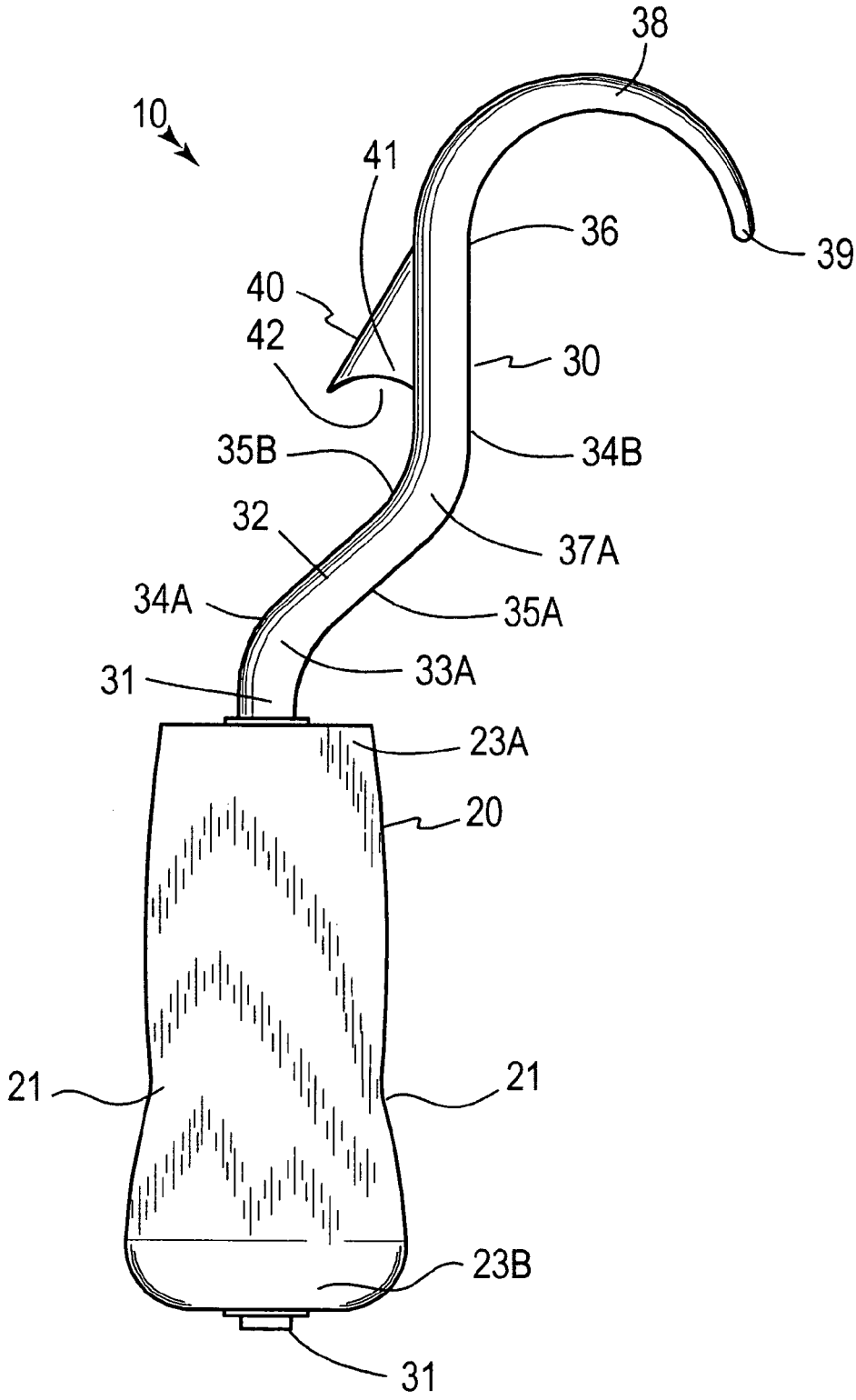
FIG. 2 is a side-elevational view of the apparatus shown in FIG. 1.
Figure 3:
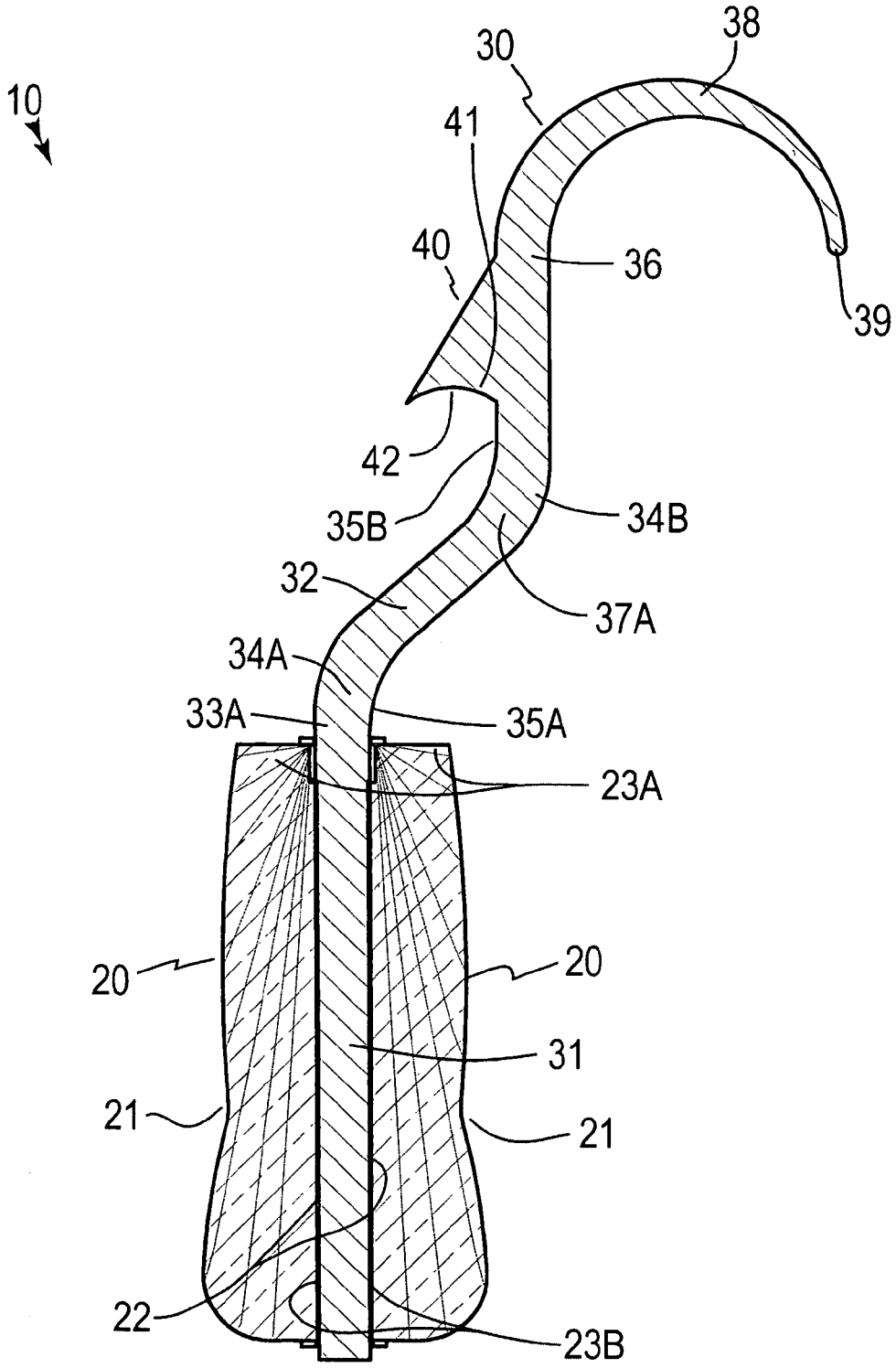
FIG. 3 is a cross-sectional view of the apparatus shown in FIG. 1, taken along line 3-3 and showing the entire length of the swivel arm.

The apparatus of this invention is referred to generally in FIGS. 1-3 by the reference numeral 10 and is intended to provide a wire cutting/tying tool. It should be understood that the apparatus 10 may be used to cut and tie many different types of wires and should not be limited in use to only rebar wire tying and cutting applications.

Referring initially to FIGS. 1, 2 and 3, the apparatus 10 includes a wooden handle 20 that has a curvilinear outer surface 21 extending along an entire longitudinal length of the handle 20, which is important for providing a convenient gripping surface when handling the apparatus 10. Of course, the handle 20 may be produced from a variety of other suitable materials, like plastic or rubber, to name a few, as is obvious to a person of ordinary skill in the art. Such a handle 20 has a centrally registered axial bore 22 formed therein, as is best shown in FIG. 3. The bore 22 travels between distal 23A and proximal 23B ends of the handle 20 such that the bore 22 effectively passes through the entire longitudinal length of the handle 20.

Again referring to FIGS. 1, 2 and 3, an elongated swivel arm 30 has an overall length greater than the longitudinal length of the handle 20. Such a swivel arm 30 is rotatably coupled directly, without the use of intervening elements, to the handle 20 such that the swivel arm conveniently freely rotates along clockwise and counter clockwise directions. The swiveling feature of the present invention is critical for overcoming prior art shortcomings of having to manually rotate the handle 20 in the user's hand in order to rotate the swivel arm 30. The swivel arm 30 includes a first linear portion 31 that is centrally registered within the bore 22 and entirely passes through the longitudinal length of the handle 20, as is best shown in FIG. 3. Such a first linear portion 31 has a longitudinal length greater than a longitudinal length of the bore 22. This feature is critical for ensuring the swivel arm 30 is adequately supporting within the bore 22 because a shorter longitudinal length would not provide sufficient leverage and anchor for the cutting blade described hereinbelow. A plurality of bearings (not shown) are intercalated between an outer surface of the first linear portion 31 and bore 22. Such bearings are equidistantly spaced about the circumference of the first linear portion and located in a pair of clusters disposed at top and bottom openings of the bore 22.

Still referring to FIGS. 1, 2 and 3, the swivel arm 30 further includes a second linear portion 32 that is monolithically formed with a distal end 33A of the first linear portion 31. Such a second linear portion 32 extends laterally and obliquely outward from the longitudinal axis of the handle 20 and forms a first shoulder 34A with the first linear portion 31. The first shoulder 34A has a curvilinear edge 35A for effectively receiving a user's metacarpal thereagainst, which is crucial so that the user can conveniently and efficiently maintain the swivel arm 30 at a stationary position. Such a second linear portion 32 has a longitudinal length shorter than the longitudinal length of the first linear portion 31.

Yet again referring to FIGS. 1, 2 and 3, the swivel arm 30 also includes a third linear portion 36 that is monolithically formed with the second linear portion 32. Such a third linear portion 36 has a longitudinal length substantially equal to the longitudinal length of the second linear portion 32. The third linear portion 36 is vertically aligned and extends parallel to the first linear portion 31. Such a third linear portion 36 forms a shoulder 34B with a distal end 37A of the second linear portion 32, which is vital for effectively providing a curvilinear edge 35B at which another user metacarpal is simultaneously positioned to advantageously stabilize the swivel arm 30. The swivel arm 30 also further includes an arcuate portion 38 monolithically formed with the third linear portion 36. Such an arcuate portion 38 is laterally and distally displaced from the handle 20 and has a circumference outwardly offset from an outer periphery of the handle 20. The arcuate portion 38 has a hook shape and further has a tapered distal end 39 converging away from the third linear portion 36.

Still referring to FIGS. 1, 2 and 3, a cutting blade 40 is monolithically formed with the swivel arm 30. Such a cutting blade 40 is distally spaced from the handle 20 and further is axially offset from a centrally registered longitudinal axis of the handle 20. The cutting blade 40 effectively rotates in sync with the swivel arm 30. Such a cutting blade 40 also has a concave face 41. The cutting blade is proximally spaced from a distal end 39 of the swivel arm 30. Such a cutting blade 40 has a substantially triangular shape and is provided with a bottom cutting edge 42 monolithically formed with the third linear portion 36.

The bottom cutting edge 42 laterally extends away from the third linear portion 36 and oppositely faces away from the arcuate portion 38 such that the arcuate portion 38 and the cutting blade 42 are offset 180 degrees. The position and shape of the cutting blade 40 provides an unexpected advantage over prior art blades because the present invention provides superior strength and mobility of the cutting blade 40 while simultaneously pivoting the swivel arm 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operated wire cutting and tying tool for improving efficiency during construction operations, said tool comprising:

a wooden handle having a curvilinear outer surface extending along an entire longitudinal length of said handle, said handle having a centrally registered axial bore formed therein, said bore traveling between distal and proximal ends of said handle such that said bore passes through the entire longitudinal length of said handle;

an elongated swivel arm having an overall length greater than the longitudinal length of said handle, said swivel arm being rotatably coupled directly to said handle such that said swivel arm freely rotates along clockwise and counter clockwise directions; and a cutting blade monolithically formed with said swivel arm, said cutting blade being distally spaced from said handle and further being axially offset from a centrally registered longitudinal axis of said handle;

wherein said cutting blade rotates in sync with said swivel arm;

wherein said swivel arm comprises a first linear portion centrally registered within said bore and entirely passing through the longitudinal length of said handle, said first linear portion having a longitudinal length greater than a longitudinal length of said bore;

wherein said swivel arm further comprises:

a second linear portion monolithically formed with a distal end of said first linear portion, said second linear portion extending laterally and obliquely outward from the longitudinal axis of said handle and forming a first shoulder with said first linear portion, said first shoulder having a curvilinear edge for receiving a user's metacarpal thereagainst so that the user can efficiently maintain said swivel arm at a stationary position, said second linear portion having a longitudinal length shorter than the longitudinal length of said first linear portion;

wherein said swivel arm further comprises a third linear portion monolithically formed with said second linear portion, said third linear portion having a longitudinal length substantially equal to the longitudinal length of said second linear portion, said third linear portion being vertically aligned and extending parallel to said first linear portion, said third linear portion forming a shoulder with a distal end of said second linear portion for providing a curvilinear edge at which another user's metacarpal is simultaneously positioned to stabilize said swivel arm.

2. The tool of claim 1, wherein said swivel arm further comprises:

an arcuate portion monolithically formed with said third linear portion, said arcuate portion being laterally and distally displaced from said handle and having a circumference outwardly offset from an outer periphery of said handle, said arcuate portion having a hook shape and further having a tapered distal end converging away from said third linear portion.

3. The tool of claim 1, wherein said cuffing blade has a substantially triangular shape and is provided with a bottom cutting edge monolithically formed with said third linear portion, said bottom cutting edge laterally extending away from said third linear portion and oppositely facing away from said arcuate portion such that said arcuate portion and said cutting blade are offset 180 degrees.

4. A hand-operated wire cutting and tying tool for improving efficiency during construction operations, said tool comprising:

a wooden handle having a curvilinear outer surface extending along an entire longitudinal length of said handle, said handle having centrally registered axial bore formed therein, said bore traveling between distal and proximal ends of said handle such that said bore passes through the entire longitudinal length of said handle;

an elongated swivel arm having an overall length greater than the longitudinal length of said handle, said swivel arm being rotatably coupled directly to said handle such that said swivel arm freely rotates along clockwise and counter clockwise directions; and a cutting blade monolithically formed with said swivel arm, said cutting blade being distally spaced from said handle and further being axially offset from a centrally registered longitudinal axis of said handle;

wherein said cutting blade rotates in sync with said swivel arm, wherein said cutting blade has a concave face;

wherein said swivel arm comprises a first linear portion centrally registered within said bore and entirely passing through the longitudinal length of said handle, said first linear portion having a longitudinal length greater than a longitudinal length of said bore;

wherein said swivel arm further comprises;

a second linear portion monolithically formed with a distal end of said first linear portion, said second linear portion extending laterally and obliquely outward from the longitudinal axis of said handle and forming a first shoulder with said first linear portion, said first shoulder having a curvilinear edge for receiving a user's metacarpal thereagainst so that the user can efficiently maintain said swivel arm at a stationary position, said second linear portion having a longitudinal length shorter than the longitudinal length of said first linear portion;

wherein said swivel arm further comprises a third linear portion monolithically formed with said second linear portion, said third linear portion having a longitudinal length substantially equal to the longitudinal length of said second linear portion, said third linear portion being vertically aligned and extending parallel to said first linear portion, said third linear portion forming a shoulder with a distal end of said second linear portion for providing a curvilinear edge at which another user's metacarpal is simultaneously positioned to stabilize said swivel arm.

5. The tool of claim 4, wherein said swivel arm further comprises:

an arcuate portion monolithically formed with said third linear portion, said arcuate portion being laterally and distally displaced from said handle and having a circumference outwardly offset from an outer periphery of said handle, said arcuate portion having a hook shape and further having a tapered distal end converging away from said third linear portion.

6. The tool of claim 4, wherein said cutting blade has a substantially triangular shape and is provided with a bottom cutting edge monolithically formed with said third linear portion, said bottom cutting edge laterally extending away from said third linear portion and oppositely facing away from said arcuate portion such that said arcuate portion and said cutting blade are offset 180 degrees.

7. A hand-operated wire cuffing and tying tool for improving efficiency during construction operations, said tool comprising:

a wooden handle having a curvilinear outer surface extending along an entire longitudinal length of said handle, said handle having centrally registered axial bore formed therein, said bore traveling between distal and proximal ends of said handle such that said bore passes through the entire longitudinal length of said handle;

an elongated swivel arm having an overall length greater than the longitudinal length of said handle, said swivel arm being rotatably coupled directly to said handle such that said swivel arm freely rotates along clockwise and counter clockwise directions; and a cutting blade monolithically formed with said swivel arm, said cutting blade being distally spaced from said handle and further being axially offset from a centrally registered longitudinal axis of said handle;

wherein said cutting blade rotates in sync with said swivel arm, wherein said cutting blade has a concave face, wherein said cutting blade is proximally spaced from a distal end of said swivel arm;

wherein said swivel arm comprises a first linear portion centrally registered within said bore and entirely passing through the longitudinal length of said handle, said first linear portion having a longitudinal length greater than a longitudinal length of said bore;

wherein said swivel arm further comprises a second linear portion monolithically formed with a distal end of said first linear portion, said second linear portion extending laterally and obliquely outward from the longitudinal axis of said handle and forming a first shoulder with said first linear portion, said first shoulder having a curvilinear edge for receiving a user's metacarpal thereagainst so that the user ban efficiently maintain said swivel arm at a stationary position, said second linear portion having a longitudinal length shorter than the longitudinal length of said first linear portion;

wherein said swivel arm further comprises a third linear portion monolithically formed with said second linear portion, said third linear portion having a longitudinal length substantially equal to the longitudinal length of said second linear portion, said third linear portion being vertically aligned and extending parallel to said first linear portion, said third linear portion forming a shoulder with a distal end of said second linear portion for providing a curvilinear edge at which another user's metacarpal is simultaneously positioned to stabilize said swivel arm.

8. The tool of claim 7, wherein said swivel arm further comprises:

an arcuate portion monolithically formed with said third linear portion, said arcuate portion being laterally and distally displaced from said handle and having a circumference outwardly offset from an outer periphery of said handle, said arcuate portion having a hook shape and further having a tapered distal end converging away from said third linear portion.

9. The tool of claim 7, wherein said cutting blade has a substantially triangular shape and is provided with a bottom cutting edge monolithically formed with said third linear portion, said bottom cutting edge laterally extending away from said third linear portion and oppositely facing away from said arcuate portion such that said arcuate portion and said cutting blade are offset 180 degrees.

* * * * *